US007618152B2

(12) United States Patent
Tsung

(10) Patent No.: US 7,618,152 B2
(45) Date of Patent: Nov. 17, 2009

(54) LIGHTING STRUCTURE FOR A FLEXIBLE EXTENSION BAR

(76) Inventor: Kuo-Hua Tsung, No. 355-1, Lunmei Rd., Changhua City, Changhua County (TW)

( * ) Notice: Subject to any disclaimer, the term of this patent is extended or adjusted under 35 U.S.C. 154(b) by 255 days.

(21) Appl. No.: 11/868,402

(22) Filed: Oct. 5, 2007

(65) Prior Publication Data

US 2008/0266848 A1 Oct. 30, 2008

(30) Foreign Application Priority Data

Apr. 24, 2007 (TW) ..... 96206514 U

(51) Int. Cl.
*B25B 23/18* (2006.01)

(52) U.S. Cl. ..... 362/119; 362/120; 362/201; 362/198

(58) Field of Classification Search ..... 362/119, 362/120, 201, 200, 196–199, 188, 109, 253, 362/800
See application file for complete search history.

(56) References Cited

U.S. PATENT DOCUMENTS 5,791,763 A * 8/1998 Kam-Hoi ..... 362/183
6,854,861 B2 * 2/2005 Chao ..... 362/197
6,874,908 B2 * 4/2005 Sharrah et al. ..... 362/187
2006/0215395 A1 * 9/2006 Yen ..... 362/119

* cited by examiner

*Primary Examiner*—Bao Q Truong
(74) *Attorney, Agent, or Firm*—Egbert Law Offices PLLC

(57) ABSTRACT

The present invention provides a lighting structure of a flexible extension bar, which is assembled only the actuating end of the flexible extension bar. The lighting structure includes a coupling seat, a lid, a slip controller and LED light. The slip controller is assembled into an accommodating space of the coupling seat. The slip controller is provided with a fuel cell accommodating portion that defines two openings. The dialing portion of the slip controller is protruded from the lid. The light-emitting portion of LED light is protruded from the coupling seat. Two conductive pins are extended alternatively into the accommodating space of the coupling seat. The ends of the two conductive pins are formed into shapes of irregular length, and placed opposite the two openings of the fuel cell accommodating portion. The flexible extension bar lighting structure presents simple construction, cost-effectiveness, space-saving and ease-of-operation.

7 Claims, 5 Drawing Sheets

LIGHTING STRUCTURE FOR A FLEXIBLE EXTENSION BAR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a flexible extension bar, and more particularly to an extension bar with an innovative lighting structure.

2. Description of Related Art Including Information Disclosed Under 37 CFR 1.97 and 37 CFR 1.98.

The flexible extension bar is a supportive tool that is provided with a flexible bar and assembly ends at both sides of the bar (e.g. hexagon column at one side, and hexagon groove at the other side). With the actuating end assembled onto the tool, said flexible extension bar allows addition of a flexible extension section for bolting jobs in narrow and bending space.

However, when the aforementioned flexible extension bar is employed in narrow and bending spaces, the problem of dim light will be encountered. Individual users may find it difficult to operate and visualize the flexible extension bar while holding flashlight; thus, an important topic for this industry is how to develop a lighting structure suitable for the flexible extension bar.

The previous patents related to the present invention involved flexible picker structures with lighting devices, as disclosed in Taiwan patent No. M250765, entitled "A Flexible Picker with Lighting Absorber", and Taiwan patent No. 375079, entitled "A Lighting Picker". However, these typical patents were not associated with an extension bar, and the picker was designed with a handle, wherein the fuel cell, conducting component and switch can be assembled. Then, the luminous body is assembled at one end of the flexible picker. So, the lighting structure of such a flexible picker requires only simple technology, and a great number of components can be incorporated without little space limitations. But the flexible extension bar for the present invention is only a slender bar without a bigger handle, making it difficult to directly add a lighting structure of the flexible picker as mentioned above.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The lighting structure B is only composed of said coupling seat 20, lid 30, slip controller 40 and LED light 50. So, it is possible to improve the cost-effectiveness and improve the economic performance with respect to manufacturing and assembly.

Owing to extremely simple and space-saving components of said lighting structure B, it is particularly suited for being assembled into actuating end 12 of flexible extension bar A for favorable illumination. Moreover, with this simple design of lighting structure B, the added volume of flexible extension bar A could be minimized (shown in FIG. 1) while normal and smooth operation is maintained.

Said lighting structure B only permits turning the dialing portion 42 of the slip controller 40 for switching the LED light 50, thus improving ease-of-operation with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
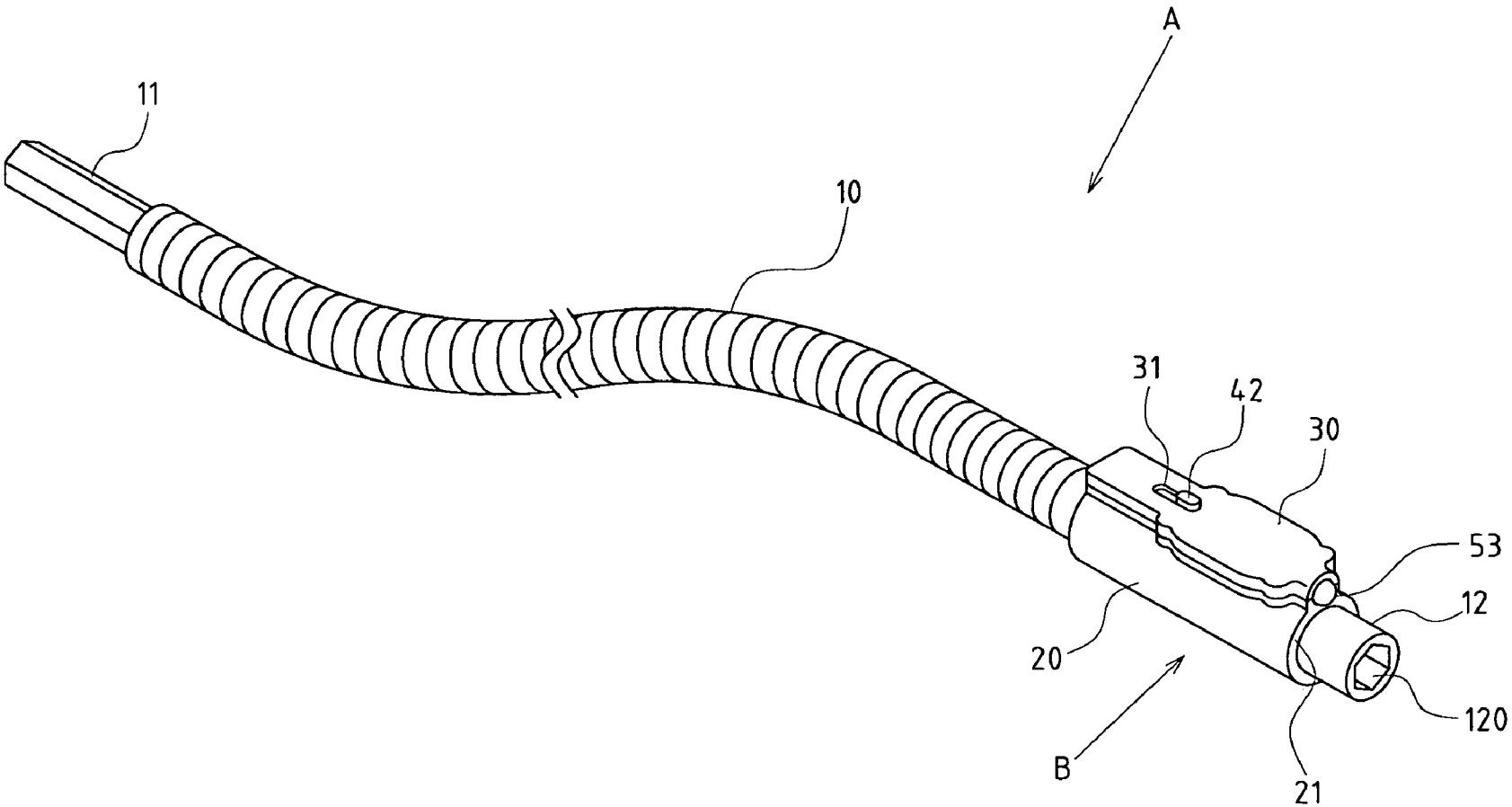
FIG. 1 shows an assembled perspective view of the present invention.
Figure 2:
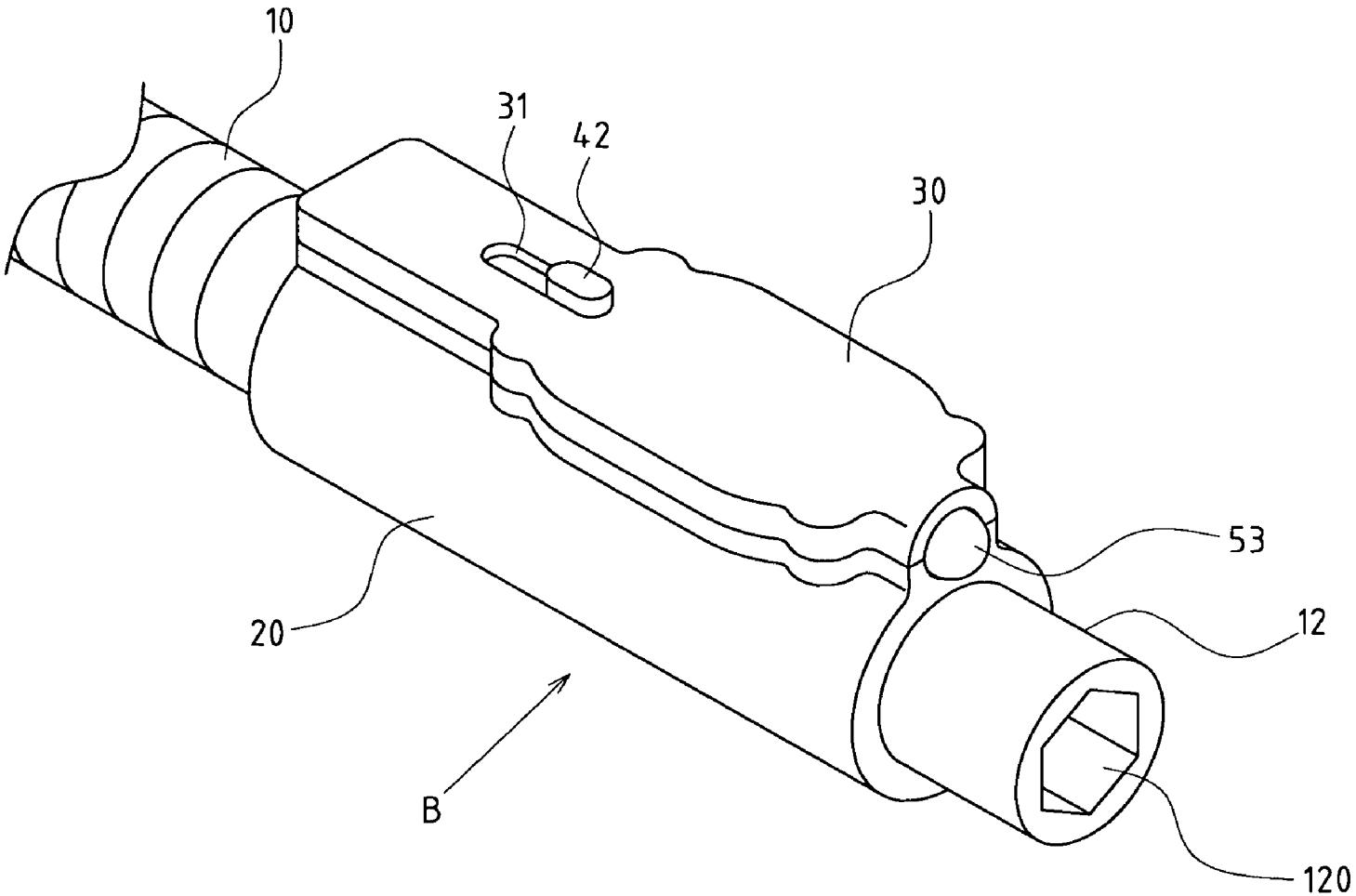
FIG. 2 shows a partially enlarged perspective view of FIG. 1.
Figure 3:
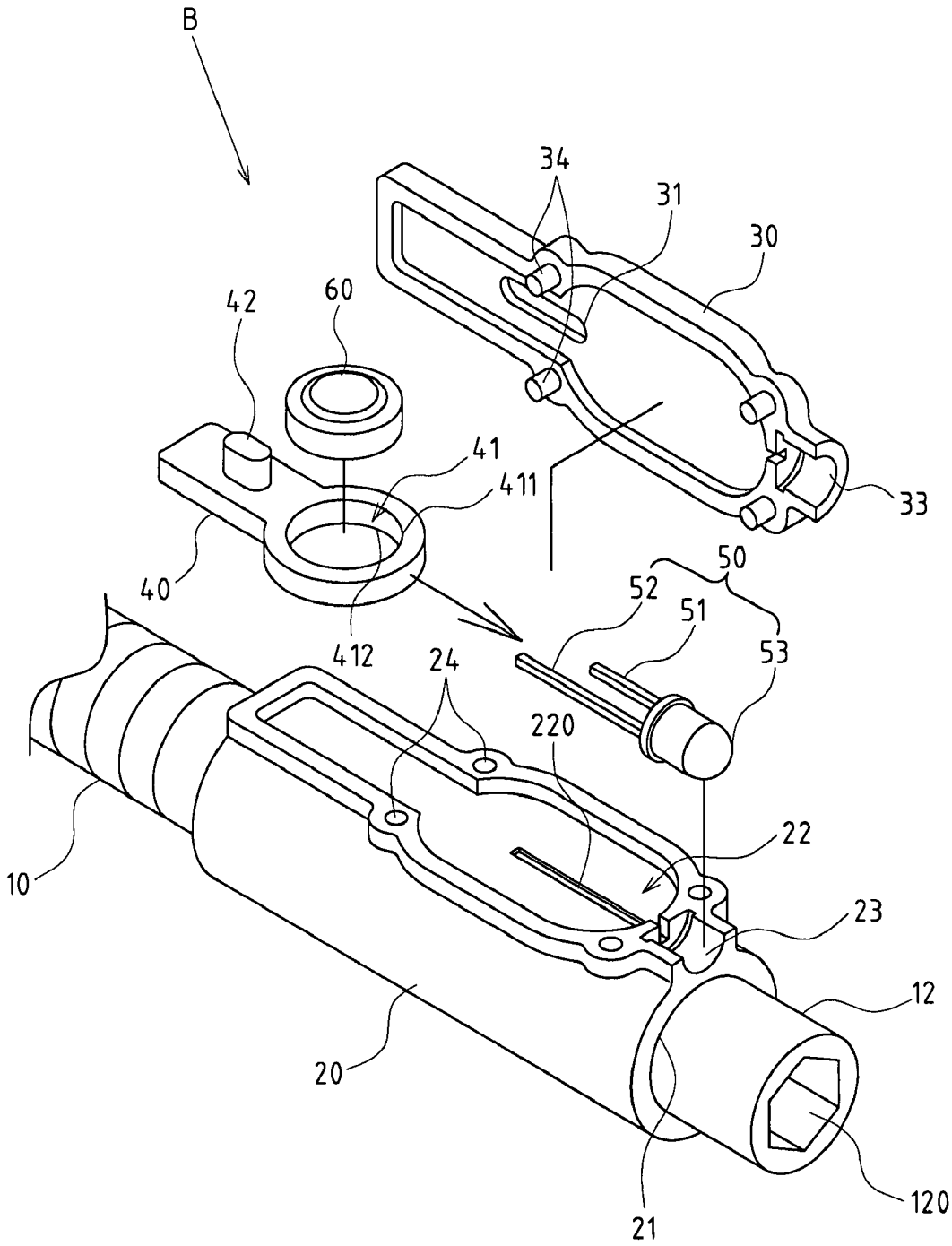
FIG. 3 shows an exploded perspective view of the present invention.

FIGS. 1-3 depict preferred embodiments of a lighting structure for a flexible extension bar of the present invention. The embodiments are provided only for explanatory purposes. The scope of the invention is set by the patent claims.

The flexible extension bar A comprises a flexible bar 10, a driven end 11 assembled at a first end of the bar 10, and an actuating end 12 assembled at the second end of the bar 10. The lighting structure B is mounted externally onto the actuating end 12.

The lighting structure B comprises a coupling seat 20, which contains a coupling portion 21 for external positioning on the actuating end 12 of the flexible extension bar A. The coupling portion 21 of the present invention is sleeved onto actuating end 12 of the flexible extension bar A. One side of the coupling seat 20 is provided with an accommodating space 22, which is a groove.

A lid 30 is used to cover the opening of accommodating space 22 of the coupling seat 20.

A slip controller 40 is assembled into accommodating space 22 of the coupling seat 20 in a slipping state. The slip controller 40 is provided with a fuel cell accommodating portion 41 for accommodating the fuel cell 60. The fuel cell accommodating portion 41 defines a first opening 411 and second opening 412. The slip controller 40 is provided with a dialing portion 42 protruding from a through-hole 31 of lid 30. The dialing portion 42 has a button shape.

An LED light 50 comprises a light-emitting portion 53 and two conductive pins 51, 52. The light-emitting portion 53 is protruded from the coupling seat 20, while two conductive pins 51, 52 are extended alternatively into accommodating space 22 of the coupling seat 20. The ends of two conductive pins 51, 52 are shapes of irregular length and placed opposite to the first opening 411 and second opening 412 of fuel cell accommodating portion 41 of the slip controller 40. When the slip controller 40 shifts to the preset first position, two conductive pins 51, 52 are aligned with the fuel cell accommodating portion 41. When the slip controller 40 shifts to the preset second position, the shorter conductive pins 51 misaligns with the fuel cell accommodating portion 41.

Semicircular grooves 23, 33 are correspondingly placed at the same end of the coupling seat 20 and lid 30, so that a circular groove is formed to accommodate and position the light-emitting portion 53 of LED light 50.

The driven end 11 of the flexible extension bar A 10 is a hexagon column, and the actuating end 12 of the bar 10 is a column with hexagon groove 120.

On the inner wall of accommodating space 22 of the coupling seat 20, a trough 220 is assembled for inserting the conductive pins 52.

At the junction of the lid 30 and coupling seat 20, columns 34 are coupled with jacks 24, so that the lid 30 and coupling seat 20 can be positioned securely.

Based upon the above-specified structures, the present invention is operable. Referring to FIGS. 2, 3, the improved flexible extension bar A of the present invention lies in the lighting structure B. When the user intends to use the lighting structure B, it is required to first open the lid 30. The fuel cell 60 of predefined specification is put into the fuel cell accommodating portion 41 of the slip controller 40, and the lid 30 is closed. Now, lighting structure B can be operated.

Figure 4:
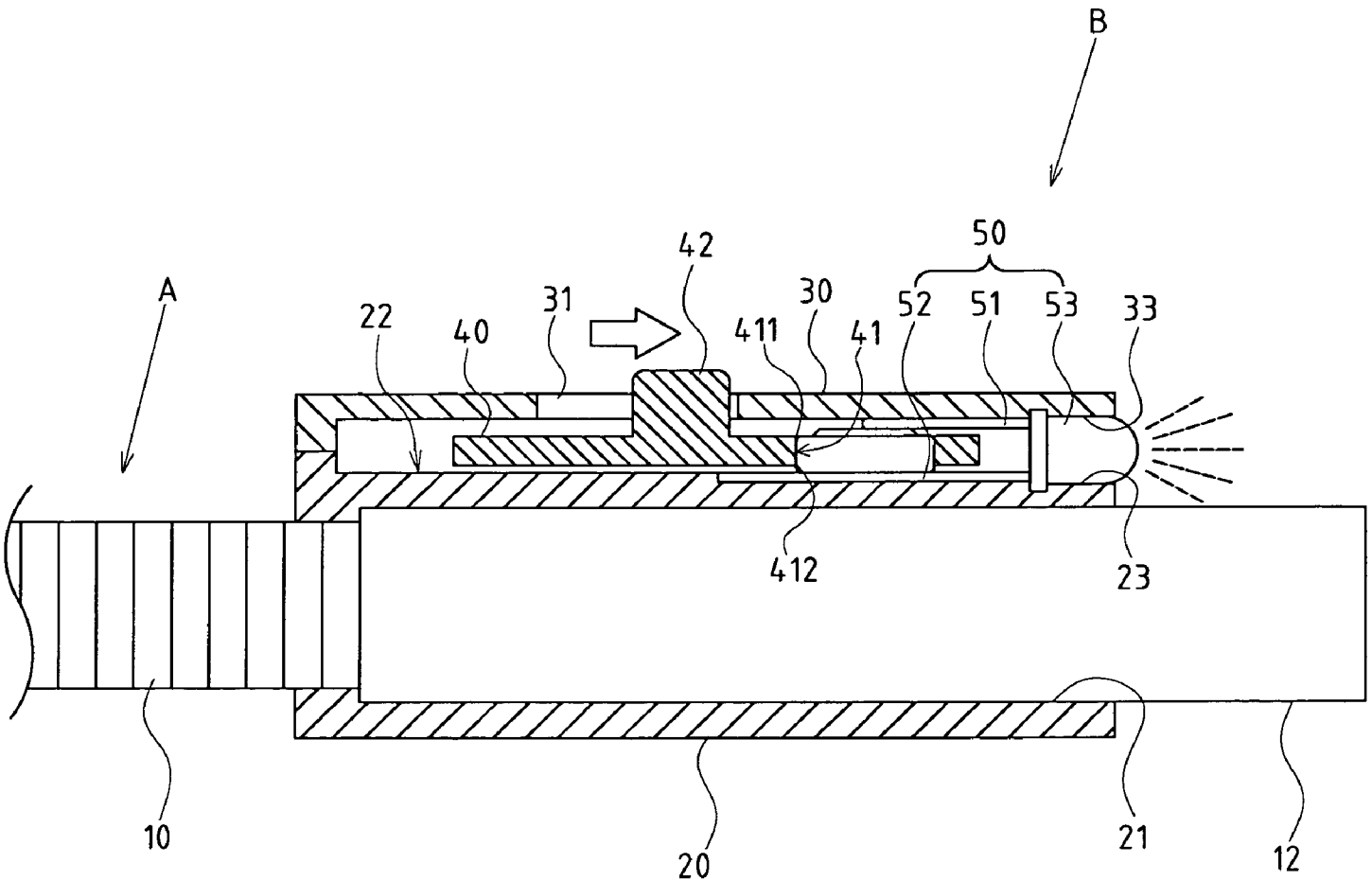
FIG. 4 shows an assembled sectional view of the present invention.

Referring to FIG. 4, when the user turns the dialing portion 42 of the slip controller 40 and enables the slip controller 40 to shift to the preset first position, two conductive pins 51, 52 of LED light 50 correspond to the fuel cell accommodating portion 41. The positive and negative poles of fuel cell 60 are electrically connected, so the light-emitting portion 53 of LED light 50 is highlighted.

Figure 5:
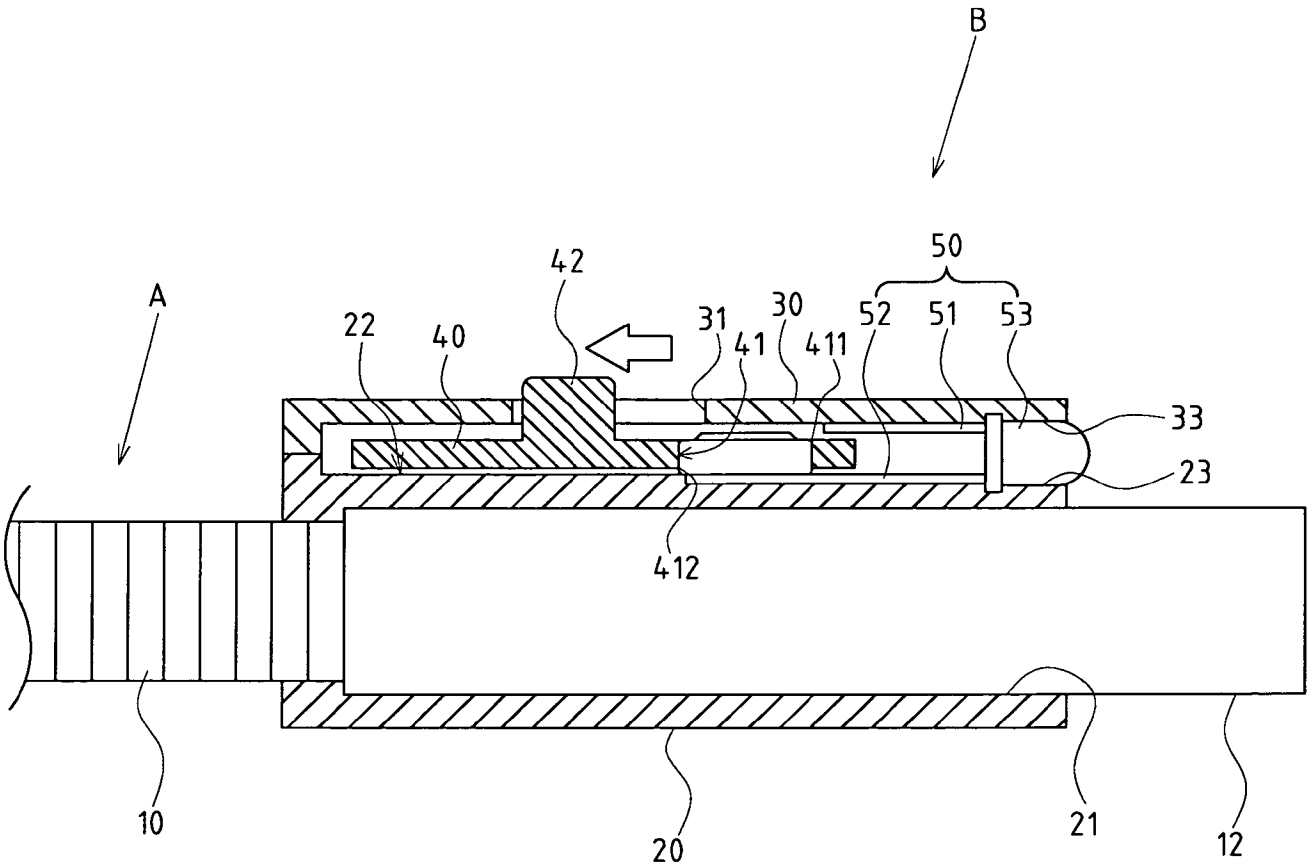
FIG. 5 shows a sectional view of the operation of the present invention.

Referring also to FIG. 5, when the slip controller 40 shifts to the preset second position, the shorter conductive pins 51 misalign with the fuel cell accommodating portion 41. Only the longer conductive pins 52 are electrically connected to a pole of fuel cell 60 so the light-emitting portion 53 of LED light 50 is extinguished.

I claimed:

1. A lighting structure for a flexible extension bar, wherein said flexible extension bar comprises a flexible bar, a driven end assembled at a first end of the bar, and an actuating end assembled at a second end of the bar, said lighting structure being mounted externally onto said actuating end, said lighting structure comprising:

a coupling seat having a coupling portion for positioning externally onto said actuating end of said flexible extension bar, and an accommodating space;

a lid, covering said accommodating space of said coupling seat;

a slip controller, being assembled into said accommodating space in a slipping state and being provided with a fuel cell accommodating portion, said fuel cell accommodating portion defining first and second openings, slip controller having a dialing portion protruding from said lid;

an LED light, comprising a light-emitting portion and two conductive pins, said light-emitting portion protruding from said coupling seat, said two conductive pins alternatively extending into said accommodating space of said coupling seat and having ends formed into shapes of irregular length, said ends being placed opposite to the first and second openings of said fuel cell accommodating portion; wherein said slip controller shifts to a preset first position, said two conductive pins being aligned and electrically connected with said fuel cell accommodating portion; and wherein said slip controller shifts to a preset second position, the shorter conductive pins being misaligned with said fuel cell accommodating portion for power-off.

2. The lighting structure defined in claim 1, wherein said coupling portion is sleeved onto said actuating end of said flexible extension bar.

3. The lighting structure defined in claim 1, further comprising:

semicircular grooves correspondingly placed at a same end as said coupling seat and said lid, a circular groove being formed to accommodate said light-emitting portion of said LED light.

4. The lighting structure defined in claim 1, wherein said driven end of said flexible extension bar is a hexagon column, said actuating end being a column of hexagon groove.

5. The lighting structure defined in claim 1, wherein said dialing portion of said slip controller is a button.

6. The lighting structure defined in claim 1, wherein an inner wall of said accommodating space has a trough is assembled thereon, inserting the conductive pins therethrough.

7. The lighting structure defined in claim 1, further comprising:

columns and jacks coupled at a junction of said lid and said coupling seat, said lid and said coupling seat being positioned securely.

* * * * *